US005293146A

United States Patent [19]

Aosaki et al.

[11] Patent Number: 5,293,146

[45] Date of Patent: Mar. 8, 1994

[54] ELECTRIC COIL DEVICE FOR USE AS A TRANSFORMER OR THE LIKE

[75] Inventors: Yoshiki Aosaki, Sakado; Tadashi Yamaguchi, Toubumachi, both of Japan

[73] Assignees: Sanken Electric Co., Ltd., Japan; Totoku Electric Co., Ltd., Japan

[21] Appl. No.: 709,481

[22] Filed: Jun. 3, 1991

[30] Foreign Application Priority Data

Jun. 8, 1990 [JP] Japan ..... 2-150174

[51] Int. Cl.[5] ..... H01F 27/30

[52] U.S. Cl. ..... 336/206; 156/56; 174/120 R; 428/377

[58] Field of Search ..... 336/206, 846, 205, 222; 174/120 R, 120 AR, 120 SR, 110 N, 110 R; 428/371, 377, 906; 156/53, 56

[56] References Cited

U.S. PATENT DOCUMENTS

| | | | |
|---|---|---|---|
| 3,422,215 | 1/1969 | Humes | 174/120 R |
| 3,488,537 | 1/1970 | Beddows | 310/179 |
| 3,617,617 | 11/1971 | Katz | 174/120 SR |
| 3,735,168 | 5/1973 | Anderson et al. | 336/209 X |
| 4,733,213 | 3/1988 | Graul | 336/206 |
| 4,900,879 | 2/1990 | Buck et al. | 174/120 R |

FOREIGN PATENT DOCUMENTS 62-293705 12/1987 Japan .

*Primary Examiner*—Leo P. Picard
*Assistant Examiner*—Christopher Horgan
*Attorney, Agent, or Firm*—Woodcock Washburn Kurtz Mackiewicz & Norris

[57] ABSTRACT

A transformer is disclosed which has a primary and a secondary winding disposed concentrically around a core via a flanged bobbin. Each winding has a conductor wire which is doubly or, preferably, triply sheathed with insulating tapes of different widths. The first or inmost insulating tape is wound overlappingly in a first direction around the conductor wire without being bonded thereto. The second or intermediate insulating tape, less in width than the first, is wound overlappingly in a second direction, opposite to the first direction, over the first insulating tape and bonded thereto via a preformed adhesive layer on the second insulating tape. The third or outmost insulating tape, still less in width than the second, is wound overlappingly in the first direction over the second insulating tape and bonded thereto via a preformed adhesive layer on the third insulating tape. The ratio of the overlap of each tape to the tape width becomes progressively less from the inmost toward the outmost tape. With the conductor wires of the two concentric windings thus individually insulated, no additional insulations are required for the transformer.

6 Claims, 4 Drawing Sheets

ELECTRIC COIL DEVICE FOR USE AS A TRANSFORMER OR THE LIKE

BACKGROUND OF THE INVENTION

Our invention relates generally to electric coil devices having a coil or coils wound around a core, and particularly to those suitable for use as transformers of switching regulators. However, we do not wish out invention to be limited to this particular application as the coil devices constructed according to our invention lend themselves to use as chokes and to additional applications.

Conventionally, in a typical small size transformer, the primary and the secondary windings have been arranged concentrically around a flanged bobbin sleeved upon a core. The primary and the secondary windings have been insulated from each other with three or more sheets or layers of special paper. Insulating spacers, known as barriers, have been placed next to the bobbin flanges. Insulating tubes have also been sleeved upon the leads of the primary winding.

We object to the use of the insulating paper, barriers and tubes as they make difficult and troublesome the assemblage of the transformer. Moreover, the insulating paper and barriers add considerably to the size of the transformer. It is also a disadvantage that the three or more sheets or layers of insulating paper increases the distance between the primary and the secondary windings, with a consequent decrease in electromagnetic coupling therebetween.

Japanese Unexamined Patent Publication No. 62-293705 represents a solution to this problem. It teaches to dispense with the insulating paper, barriers and tubes by use of insulated conductors for the primary and the secondary windings.

We object to this known solution, too. It has been very difficult to enclose conductor wires in coverings that are sufficiently thin but can well perform the functions for which they are intended. Consequently, the transformers made with such insulated conductors have not been reduced so much in size, or have not been so favorable in performance characteristics, as could be desired. The insulated conductors have also offered the disadvantage that parts of the insulating coverings have had to be removed to expose the corresponding parts of the conductors for connection to terminals. Such removal of the insulating coverings has represented a substantial impediment to the ease of manufacture of the transformers.

SUMMARY OF THE INVENTION

We have hereby invented how to construct an electric coil device, suitable for use as a transformer or the like, that is compact in size, simple and reliable in construction, favorable in performance, and economical of manufacture.

Briefly, out invention may be summarized as an electric coil device having at least one winding around a core. The winding is formed by a conductor wire around which at least two insulating tapes of different widths are wound one over the other and each with an overlap. The ratio of the width of the overlap of the first of the two insulating tapes to the width of the first tape is different from the ratio of the width of the overlap of the second insulating tape to the width of this second insulating tape.

Preferably, that one of the two insulating tapes which is greater in width may first be wound overlappingly around the conductor wire, with the width of the overlap made more than one half, preferably more than two thirds, of the tape width. Then the narrower second insulating tape may be wound overlappingly over the first insulating tape, with the ratio of the width of the overlap of this second tape to the width of the second tape made less than the ratio of the overlap of the first tape to the width of the first tape. As desired or required, a third insulating tape, which is still less in width than the second tape, may be wound overlapping over the second insulating tape, with the ratio of the width of the overlap of the third tape to the width of the third tape made less than the ratio of the overlap of the second tape to the width of the second tape.

With the overlap width of the widest first insulating tape made more than one half, or preferably more than two thirds, of the tape width, the conductor wire can be covered by two or three turns of the first tape alone and so can be insulated against a fairly high voltage. The second insulating tape serves the dual purpose of enhancing the voltage withstanding capability of the insulating tape sheath over the conductor and of protecting the first tape. The third insulating tape is meant mostly to protect the first and the second tapes. Thus, being more than amply protected against deterioration or destruction due to external causes, and being capable of withstanding the expected highest voltage with more than a safe margin, the insulating tape sheath according to our invention contributes materially to the longer life of the electric coil device under the most rigorous conditions of use.

We recommend that the first insulating tape be not bonded to the conductor wire. The second insulating tape may be bonded to the first tape via a performed adhesive layer on one side of the second tape. The third insulating tape, if any, may also be bonded to the second tape via a preformed adhesive layer on one side of the third tape. Then the opposite end portions of the conductor wire will be readily stripped of the insulating tape sheath for electrical connection to terminal pieces.

We also recommend that the first and the second insulating tapes be wound in opposite directions. The third insulating tape, if any, may be wound in a direction opposite to the winding direction of the intermediate second tape. In this manner, even though the inmost first tape is not bonded to the conductor wire, the three tapes will not loosen or come off the conductor wire.

The above and other features and advantages of our invention and the manner of realizing them will become more apparent, and the invention itself will best be understood, from a study of the following description and appended claims, with reference had to the attached drawings showing a preferred embodiment of our invention.

DESCRIPTION OF THE PREFERRED EMBODIMENT

Figure 1:
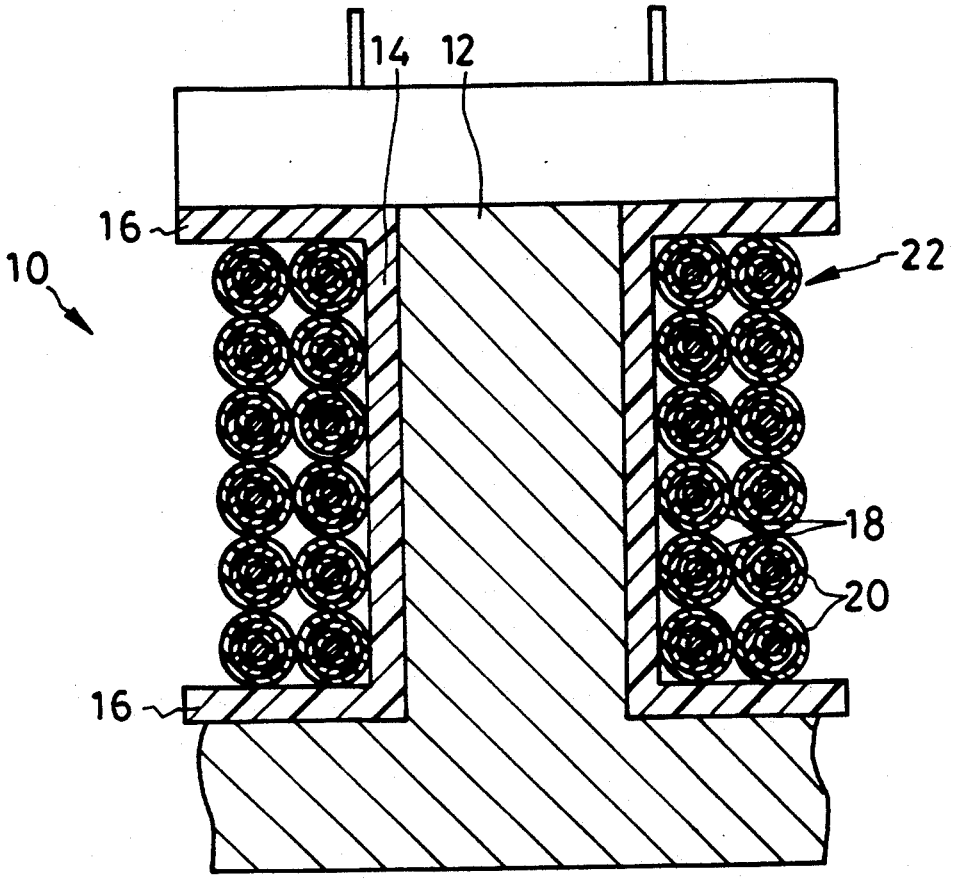
FIG. 1 is a partial section through a transformer constructed in accordance with the principles of our invention.

We will now describe our invention in detail as embodied in the high frequency transformer of a switching regulator illustrated in FIG. 1. Generally designated 10, the transformer has a magnetic core 12 on which there is sleeved a tubular bobbin 14 having a pair of flanges 16 on its opposite ends. Around the bobbin 14, and fully between the pair of flanges 16 thereon, a primary winding 18 and a secondary winding 20 are arranged concentrically, with the primary next to the bobbin.

We have shown only part of the magnetic core 12 because of its conventional nature. In practice the core may be of tripod configuration consisting of a combination of E and I cores. The primary 18 and the secondary 20 may surround the center leg of the tripod core.

It will be also noted from FIG. 1 that unlike the prior art, no insulating paper is provided between the primary 18 and the secondary 20. Nor are the conventional barriers provided next to the flanges 16 on the bobbin 14; instead, the primary 18 and the secondary 20 are disposed substantially all over the tubular body of the bobbin 14.

The transformer primary 18 and secondary 20 must be electrically insulated from each other against a voltage of, say, 3750 volts in this particular embodiment. In order to meet this requirement we have employed insulated conductor wires for both primary 18 and secondary 20. In practice the insulated conductor for the primary 18 and that for the secondary 20 may differ in details of construction because of the required difference between their current carrying capacities. However, purely for the purposes of illustrating our invention, such differences in constructional details are negligible, and we have shown the insulated conductors for both primary 18 and secondary 20 to be of the same construction in order to facilitate explanation.

Figure 2:
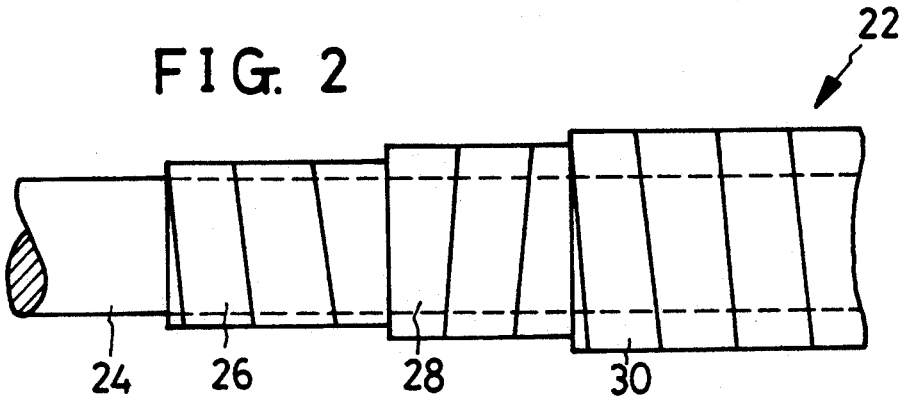
FIG. 2 is an enlarged, partial elevation of the insulated wire of which the windings of the transformer of FIG. 1 are each made.

FIG. 2 is an enlarged, more detailed illustration of the insulated conductor, generally labeled 22, that can be employed for each of the transformer primary 18 and secondary 20. The insulated conductor 22 comprises a conductor wire 24, a first insulating tape 26 wound on the conductor, a second insulating tape 28 wound on the first insulating tape, and a third insulating tape 30 wound on the second insulating tape. In both FIGS. 1 and 2, as well as in the subsequent figures yet to be referred to, we have shown the thicknesses of the three insulating tapes 26, 28 and 30 exaggerated for convenience in illustration.

The insulated conductor 22 of the above general construction may, of course, differ in details of manufacture according to each intended application. However, we may specify the details of the insulated conductor 22 as follows by way of example and for better illustration of our invention.

The conductor wire 24 of the insulated conductor 22 is of annealed copper and has a diameter of 0.4 millimeter.

Figure 3A:
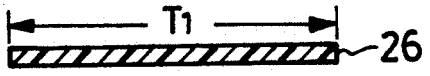
FIG. 3A is an enlarged cross section through the inmost one of the three insulating tapes wound around the wire of FIG. 2.
Figure 3B:
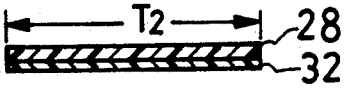
FIG. 3B is an enlarged cross section through the intermediate one of the three insulating tapes wound around the wire of FIG. 2.
Figure 3C:
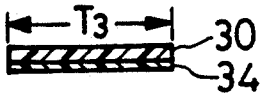
FIG. 3C is an enlarged cross section through the outmost one of the three insulating tapes wound around the wire of FIG. 2.

We have illustrated in FIGS. 3A-3C the cross sections of the three insulating tapes 26, 28 and 30 approximately in their relative sizes. The first insulating tape 26, FIG. 3A, is made of polyester, colorless and transparent, and is 4.4 millimeters wide and 0.012 millimeter thick. No adhesive layer is formed on the first insulating tape 26. It can resist a voltage of up to approximately 2000 volts in its thickness direction. The second insulating tape 28, FIG. 3B, is made of polyester, yellow in color, and is 3.5 millimeters wide and 0.009 millimeter thick. An adhesive layer 32 is preformed on one side of the second insulating tape 28 to a thickness of 0.003 millimeter. The third insulating tape 30, FIG. 3C, is also made of polyester, orange in color, and is 2.3 millimeters wide and 0.009 millimeter thick. An adhesive layer 34 is preformed on one side of the third insulating tape 30 to a thickness of 0.003 millimeter.

Figure 4:
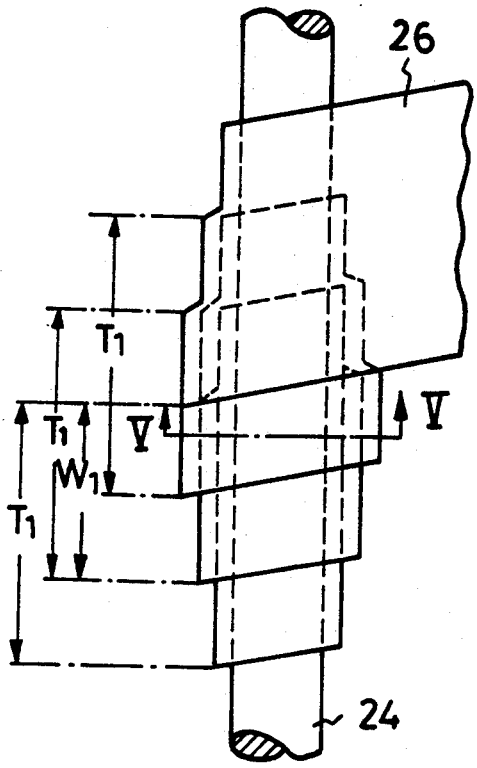
FIG. 4 is an elevational view explanatory of how the inmost insulating tape of FIG. 3A is wound around the wire.

We will now proceed to the discussion of how the three insulating tapes 26, 28 and 30 are wound on the conductor wire 24. As illustrated in FIG. 4, the first insulating tape 26 is wound overlapping and diagonally on the conductor wire 24 at an angle of fifteen degrees to a plane at right angles with the axis, or longitudinal direction, of the conductor wire 24. Typically, the overlap $W_1$ between any two adjacent turns of the first insulating tape 26 is 3.1 millimeters. Since we have assumed that the width $T_1$ of the first insulating tape 26 is 4.4 millimeters, the overlap $W_1$ amounts to as much as approximately 70 percent of the tape width.

Figure 5:
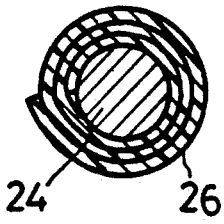
FIG. 5 is a section taken along the line V—V in FIG. 4.

FIG. 5 shows the cross section of the conductor wire 24 with the first insulating tape 26 having been wound thereon in the manner described above. It will be seen that the first insulating tape 26 is wound triply on the conductor wire 24 practically in any cross section thereof.

The first insulating tape 26 has no adhesive layer on either side as aforesaid, with the possible development of minute gaps between its lapping parts. However, such minute gaps will be effectively closed as the first insulating tape 26 is wound triply on the conductor wire 24, with the overlap $W_1$ amount to as much as 70 percent or so of the tape width $T_1$.

Figure 6:
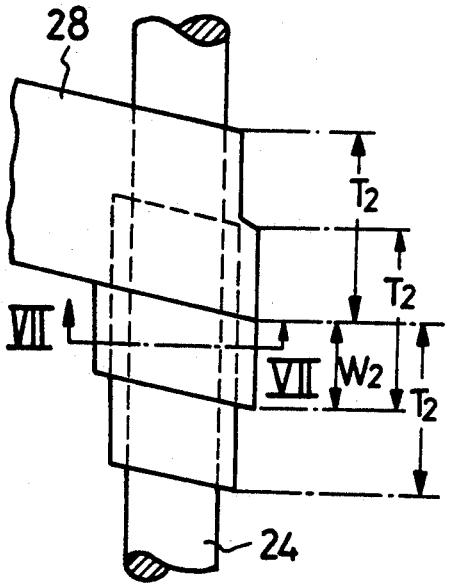
FIG. 6 is an elevational view explanatory of how the intermediate insulating tape of FIG. 3B is wound around the wire.
Figure 7:
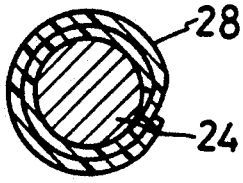
FIG. 7 is a section taken along the line VII—VII in FIG. 6.

FIGS. 6 and 7 are explanatory of how the second insulating tape 28 is wound on the first insulating tape 24 which has been wound as above on the conductor wire 24. In these figures, however, the second insulating tape 28 is shown wound directly on the conductor wire 24 for the easier understanding of how the second insulating tape itself is wound.

As will be noted from FIG. 6 taken together with FIG. 4, the second insulating tape 28 is wound overlappingly and diagonally in a direction opposite to the winding direction of the first insulating tape 26. The angle at which the second insulating tape 28 is wound is also fifteen degrees with respect to the plane at right angles with the longitudinal direction of the conductor wire 24. The overlap $W_2$ between any two adjacent turns of the second insulating tape 28 is 2.0 millimeters. Since the width $T_2$ of the second insulating tape 28 is 3.5 millimeters, the ratio of $W_2$ to $T_2$ is 0.57, which is less than the value of the ratio $W_1/T_1$ of the first insulating tape 26. Thus, as pictured cross sectionally in FIG. 7, the second insulating tape 28 is doubly wound on the conductor wire 24 via the three layers of the first insulating tape 26 which is not shown here.

Figure 8:
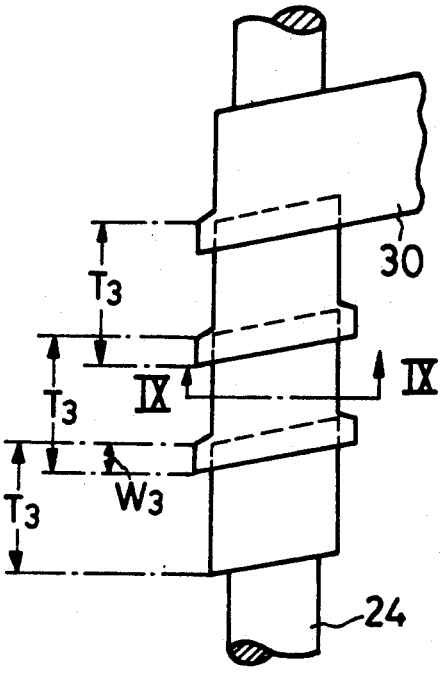
FIG. 8 is an elevational view explanatory of how the outmost insulating tape of FIG. 3C is wound around the wire.
Figure 9:
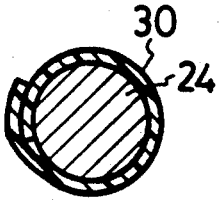
FIG. 9 is a section taken along the line IX—IX in FIG. 8.

FIGS. 8 and 9 are explanatory of how the third insulating tape 30 is wound on the second insulating tape 28 which has been wound as above on the first insulating tape 24. In these figures, too, we have shown the third insulating tape 30 to be wound directly on the conductor wire 24 for the easier understanding of how the third insulating tape itself is wound.

An inspection of FIG. 8 together with FIGS. 4 and 6 will show that the third insulating tape 30 is wound overlappingly and diagonally in the same direction as the first insulating tape 26 and in a direction opposite to the winding direction of the second insulating tape 28. The angle at which the third insulating tape 30 is wound is also fifteen degrees with respect to the plane at right angles with the longitudinal direction of the conductor wire 24. The overlap $W_3$ between any two adjacent turns of the third insulating tape 30 is as little as 0.6 millimeter. Since the width $T_3$ of the third insulating tape 30 is 2.3 millimeters, the ratio of $W_3$ to $T_3$ is 0.26, which is less than the value of the ratio $W_2/T_2$ of the second insulating tape 28. Therefore, as depicted in FIG. 9, the third insulating tape 30 is wound at least once on the conductor wire 24 in any cross section thereof via the three layers of the first insulating tape 26 and the two layers of the second insulating tape 28, which tapes 26 and 28 are both not shown here.

We have not shown in FIGS. 7 and 9 the preformed adhesive layers 32 and 34, FIGS. 3B and 3C, on the second 28 and third 30 insulating tapes. It is understood, however, that the second 28 and third 30 insulating tapes are bonded to the inner tapes and to themselves via the adhesive layers 32 and 34. Only the first insulating tape 26 is not bonded to the conductor wire 24 or to itself as this tape has no preformed adhesive layer thereon. We suggest that, after winding the three insulating tapes 26, 28 and 30 on the conductor wire 24 as above, the completed insulated conductor 22 be heated for firmly bonding together the multiple layers of the insulating tapes via the adhesive layers 32 and 34.

Figure 10:
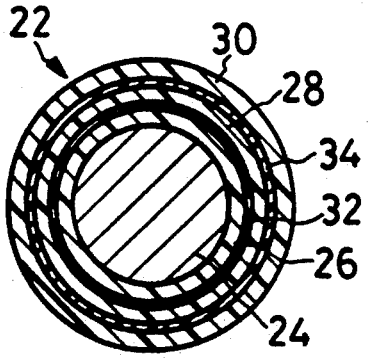
FIG. 10 is a schematic cross section through the insulated wire of FIG. 2.

The reader's attention is now invited to FIG. 10 for a consideration of the cross sectional configuration of the completed insulated conductor 22. We have shown in this figure the three insulating tapes 26, 28 and 30 as single layers of such tapes for the simplicity of illustration. It will nevertheless be understood that the three insulating tapes 26, 28 and 30 are firmly bonded together via the preformed adhesive layers 32 and 34, but that the first insulating tape 26 is not bonded to the conductor wire 24.

Figure 11:
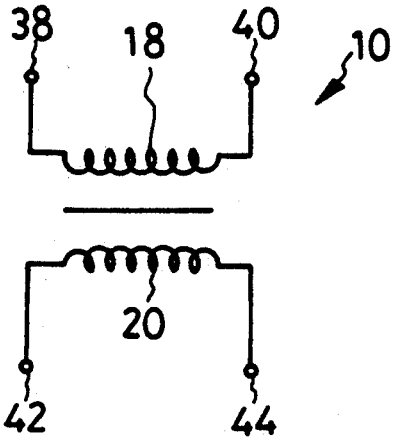
FIG. 11 is a schematic electrical diagram of the transformer of FIG. 1.

FIG. 11 is a schematic electrical diagram of the transformer 10. It has the primary 18 and the secondary 20 electrically insulated from each other. The primary 18 has its opposite extremities electrically connected to a pair of terminals 38 and 40. The secondary 20 has its opposite extremities electrically connected to another pair of terminals 42 and 44. As has been stated with reference to FIG. 10, the first or inmost insulating tape 26 of the insulated conductor 22 is not bonded to the conductor wire 24. Therefore, in electrically connecting the end portions of the insulated conductor 22 to the terminals 38, 40, 42 and 44, the required parts of the insulating tapes 26, 28 and 30 are readily removable from over the conductor wire 24.

Figure 12:
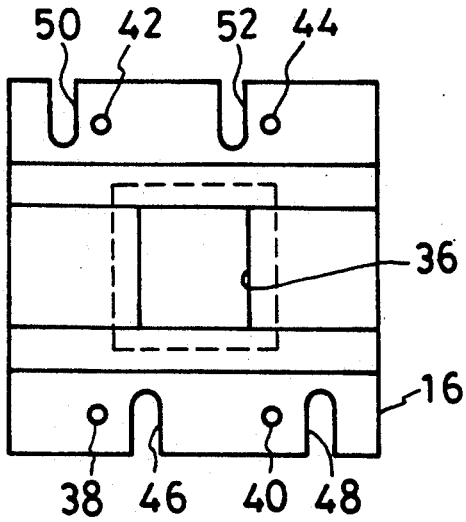
FIG. 12 is a plan of the bobbin of the transformer of FIG. 1.
Figure 13:
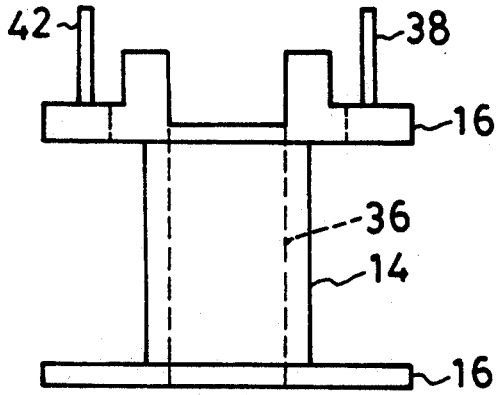
FIG. 13 is a left hand side elevation of the bobbin of FIG. 12.

Reference may be had to FIGS. 12 and 13 for a closer study of the bobbin 14 of the transformer 10. Molded from a plastic, the bobbin 14 is of square cross section, with a hollow 36 of the same cross sectional shape extending longitudinally therethrough. The noted pair of flanges 16, each square in shape as seen in a plan view as in FIG. 12, are formed on the opposite ends of the bobbin 14. One of the bobbin flanges 16 has the four metal made terminal pins 38, 40, 42 and 44 erected thereon and four recesses or notches 46, 48, 50 and 52 disposed one adjacent each terminal pin.

Figure 14:
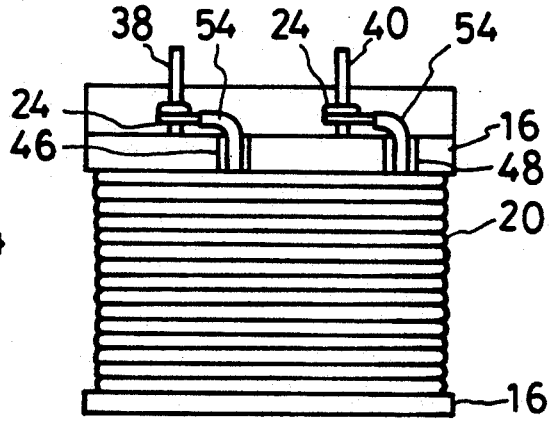
FIG. 14 is an elevation of the bobbin together with the windings formed concentrically thereon.

As will be understood from FIG. 14, which shows the completed transformer coil minus the magnetic core, the pair of lead portions 54 and 56 of the transformer primary 18 extend through the recesses 46 and 48, respectively, in one of the bobbin flanges 16 and have the bared end portions of the conductor wire 24 electrically connected to the terminal pins 38 and 40, respectively. In practice the bared end portions of the conductor wire 24 may be wound one or more turns around the terminal pins 38 and 40 and soldered thereto. It is of course understood that, although not seen in FIG. 14, the pair of lead portions of the transformer secondary 20 similarly extend through the recesses 50 and 52 and have their bared end portions similarly connected to the terminal pins 42 and 44, respectively. The spacings between the pair of terminal pins 38 and 40 and between the pair of terminal pins 42 and 44 may be suitably determined in consideration of the voltages to be handled.

Advantages

Having thus described the transformer 10 by way of a typical embodiment of our invention, we may summarize the advantages gained by this particular embodiment as follows:

1. Being wider than the second 28 and the third 30 insulating tapes, and being wound with the overlap $W_1$ greater than half the tape width $T_1$, the first insulating tape 26 provides two or more laminations of insulating material over the conductor wire 24. Thus, almost solely by this first insulating tape 26, the conductor wire 24 can be insulated against the desired voltage of 3750 volts or more.

2. The second insulating tape 28 functions not simply to add to the voltage withstanding capability of the insulated conductor 22 but additionally to protect the first insulating tape 26 against deterioration due to external causes.

3. The third insulating tape 30 is intended primarily to provide additional protection for the first insulating tape 26 rather than to enhance still further the voltage withstanding capability of the insulated conductor 22. All combined, therefore, the three insulating tapes 26, 28 and 30 make it possible for the transformer 10 to operate reliably under the most severe working conditions.

4. Despite the high voltage withstanding capability, the insulating covering on the conductor wire 24 is of minimal thickness as the widths $T_1$, $T_2$ and $T_3$, as well as the overlaps $W_1$, $W_2$ and $W_3$, of the three insulating tapes 26, 28 and 30 are made progressively less in that order.

5. The insulating tape 26, 28 and 30 can be wound on the conductor wire 24 by simple mechanical means, with the conductor wire fed longitudinally at a constant speed and with each insulating tape held at a constant angle with respect to the longitudinal direction of the wire.

6. The insulating tapes will not loosen as the second insulating tape 28 is wound in a direction opposite to the winding direction of the first insulating tape 26, and the third insulating tape 30 is wound in a direction opposite to the winding direction of the second insulating tape 28.

7. The insulating tapes are readily removable from over the end portions of the conductor wires 24 as the inmost first insulating tape 26 is wound thereon without an adhesive. Moreover, the thus bared end portions of the conductor wires 24 are readily and positively electrically connectable to the terminals 38, 40 42 and 44 since no adhesive layer is to remain on the wire end portions.

8. Being free from the conventional insulating paper, barriers, and tubes, the electric coil according to the invention can be made less in size, simpler and less expensive in construction, easier of manufacture, and higher in electromagnetic linkage, than heretofore. Concerning size reduction, we have succeeded in making a coil that is 28 percent less in volume, and 16 percent less in weight, than the prior art device of the same performance characteristics having the insulating paper, barriers and tubes.

9. Whether the three insulating tapes 26, 28 and 30 are being wound, or have been wound, correctly or not is visually observable as they are made different in color.

POSSIBLE MODIFICATIONS

Although we have shown and described the improved coil of our invention in terms of but one representative form thereof, we recognize, of course, that the representative coil is susceptible to a variety of modifications or alterations within the usual knowledge of the specialists. The following, then, is a brief list of such modifications or alterations which we believe all fall within the scope of our invention:

1. The conductor wire 24 could be insulated with only the first 26 and the second 28 insulating tapes.

2. Different materials could be employed for the three insulating tapes 26, 28 and 30. Generally, a material or materials for the first and second insulating tapes may be chosen with an emphasis on electrical insulation, and a material for the third or outmost insulating tape with an emphasis on the abilities of protecting the inner tapes from destruction or deterioration due to external causes. Preferably, the third insulating tape should be high in mechanical strength, resistant to heat and chemicals, and not permeable to water. Polyimide resins are a preferred material for the third insulating tape by reasons of their high temperature stability, excellent frictional characteristics, and good wear resistance at high temperatures.

3. The first insulating tape 28 could have a preformed adhesive layer on its side to be disposed away from the conductor wire 24.

4. An additional winding or windings could be provided, each formed from an insulated conductor according to the teachings of our invention.

5. For still tighter electromagnetic coupling, the transformer primary 18 and secondary 20 could each take the form of a bifilar winding having two insulated conductor wires, side by side, with currents traveling through them in opposite directions. It is indeed an advantage of our invention to be able to provide a compact bifilar transformer in which the windings are effectively insulated against high voltages.

6. The transformer primary 18 and secondary 20 could be wound directly on the core 12.

7. Insulating paper could be interposed between the transformer primary 18 and secondary 20 solely to remove surface irregularities of the primary and hence to facilitate the coiling of the secondary 20. Normally, one sheet of insulating paper would suffice, and the thicknesses of the second 28 and the third 30 insulating tapes might be reduced to approximately 0.004 millimeter in this case.

8. The core 12 could take various other forms such as the shell type and the toroidal.

9. The conductor wire 24 could be coated with an insulating layer of baked enamel.

What we claim is:

1. An electric coil device having a winding around a core, the winding comprising:

(a) a conductor wire;

(b) a first insulating tape of predetermined width wound in a first direction and with an overlap of predetermined width around the conductor wire, the first insulating tape being not bonded to the conductor wire;

(c) a second insulating tape having a width less than the width of the first insulating tape and wound in a second direction, opposite to the first direction, and with an overlap around the conductor wire via the first insulating tape, the ratio of the width of the overlap of the second insulating tape to the width of the second insulating tape being less than the ratio of the width of the overlap of the first insulating tape to the width of the first insulating tape, the second insulating tape being bonded to the first insulating tape; and (d) a third insulating tape having a width less than the width of the second insulating tape and wound in the first direction and with an overlap around the conductor wire via the first and the second insulating tapes, the ratio of the width of the overlap of the third insulating tape to the width of the third insulating tape being less than the ratio of the width of the overlap of the second insulating tape to the width of the second insulating tape, the third insulating tape being bonded to the second insulating tape.

2. The electric coil device of claim 1 wherein the ratio of the overlap of the first insulating tape to the width of the first insulating tape is greater than 0.5, and wherein the ratio of the overlap of the third insulating tape to the width of the third insulating tape is less than 0.5.

3. The electric coil device of claim 1 wherein the first insulating tape has no preformed adhesive layer on either side thereof, wherein the second insulating tape is bonded to the first insulating tape via an adhesive layer preformed on one side of the second insulating tape, and wherein the third insulating tape is bonded to the second insulating tape via an adhesive layer preformed on one side of the third insulating tape.

4. An electric coil device having at least two windings disposed concentrically around a core, each winding comprising:

(a) a conductor wire;

(b) a first insulating tape of predetermined width wound in a first direction and with an overlap of predetermined width around the conductor wire, the first insulating tape being not bonded to the conductor wire;

(c) a second insulating tape having a width less than the width of the first insulating tape and wound in a second direction, opposite to the first direction, and with an overlap around the conductor wire via the first insulating tape, the ratio of the width of the overlap of the second insulating tape to the width of the second insulating tape being less than the ratio of the width of the overlap of the first insulating tape to the width of the first insulating tape, the second insulating tape being bonded to the first insulating tape; and (d) a third insulating tape having a width less than the width of the second insulating tape and wound in the first direction and with an overlap around the conductor wire via the first and the second insulating tapes, the ratio of the width of the overlap of the third insulating tape to the width of the third insulating tape being less than the ratio of the width of the overlap of the second insulating tape to the width of the second insulating tape, the third insulating tape being bonded to the second insulating tape;

(e) whereby, as the conductor wires of the two windings are individually insulated with the first and the second and the third insulating tapes, no additional insulation means such as insulating paper is required between the two windings.

5. An electric coil device having two windings disposed concentrically all over the surface of a bobbin having a pair of flanges on its opposite ends, one of the flanges having two pairs of terminal pieces thereon, each winding comprising:

(a) a conductor wire having a pair of opposite end portions electrically connected to one pair of terminal pieces on one of the bobbin flanges;

(b) a first insulating tape of predetermined width wound in a first direction and with an overlap of predetermined width around the conductor wire without being bonded thereto, the width of the overlap of the first insulating tape being more than half the width of the first insulating tape;

(c) a second insulating tape having a width less than the width of the first insulating tape and wound in a second direction, opposite to the first direction, and with an overlap around the conductor wire via the first insulating tape, the second insulating tape being bonded to the first insulating tape, the ratio of the width of the overlap of the second insulating tape to the width of the second insulating tape being less than the ratio of the width of the overlap of the first insulating tape to the width of the first insulating tape; and (d) a third insulating tape having a width less than the width of the second insulating tape and wound in the first direction and with an overlap around the conductor wire via the first and the second insulating tapes, the width of the overlap of the third insulating tape being less than half the width of the third insulating tape, the ratio of the width of the overlap of the third insulating tape to the width of the third insulating tape being less than the ratio of the width of the overlap of the second insulating tape to the width of the second insulating tape, the third insulating tape being bonded to the second insulating tape;

(e) whereby, as the conductor wires of the two windings are individually insulated with the first and the second and the third insulating tapes, no additional insulation means such as insulating paper is required between the two windings, and, being not bonded to the conductor wires, the first and the second and the third insulating tapes can be readily stripped from the opposite end portions of each conductor wire for their electrical connection to the terminal pieces.

6. The electric coil device of claim 5 wherein the width of the overlap of the first insulating tape of each winding is more than two thirds of the width of the first insulating tape.

* * * * *